US006494684B1

(12) United States Patent
Wagner

(10) Patent No.: US 6,494,684 B1
(45) Date of Patent: Dec. 17, 2002

(54) LOCKING DEVICES

(75) Inventor: Stefan J Wagner, Derby (GB)

(73) Assignee: Rolls-Royce PLC, London (GB)

( * ) Notice: Subject to any disclaimer, the term of this patent is extended or adjusted under 35 U.S.C. 154(b) by 217 days.

(21) Appl. No.: 09/695,281

(22) Filed: Oct. 25, 2000

(30) Foreign Application Priority Data

Oct. 27, 1999 (GB) ..... 9925261

(51) Int. Cl.[7] ..... F01D 5/32

(52) U.S. Cl. ..... 416/248; 416/219 R; 416/220 R; 416/221; 403/278; 403/327; 403/352; 415/173.7

(58) Field of Search ..... 416/219 R, 220 R, 416/221, 248; 415/173.7; 24/457, 458; 403/350, 351, 352, 278, 326, 327; 411/87, 513, 514, 515

(56) References Cited

U.S. PATENT DOCUMENTS

| | | | | | |
|---|---|---|---|---|---|
| 1,913,555 | A | * | 6/1933 | Lyle | 411/515 |
| 2,697,621 | A | * | 12/1954 | Frederick | 403/351 |
| 2,786,648 | A | * | 3/1957 | Ledwith | 416/221 |
| 3,096,074 | A | * | 7/1963 | Pratt et al. | 416/221 |
| 3,841,794 | A | * | 10/1974 | Bergmann | 416/221 |
| 4,232,978 | A | | 11/1980 | Cohen | |
| 4,389,161 | A | * | 6/1983 | Brumen | 416/220 R |
| 5,490,662 | A | | 2/1996 | Wright | |
| 6,106,234 | A | * | 8/2000 | Gabbitas | 416/221 |

FOREIGN PATENT DOCUMENTS

| | | | | |
|---|---|---|---|---|
| DE | 3220627 A1 | * | 12/1983 | 403/326 |
| DE | 38 36 321 | | 4/1990 | |
| EP | 0 169 799 | | 1/1986 | |
| GB | 1177779 | | 1/1970 | |
| JP | 56-72298 A | * | 6/1981 | 416/221 |

* cited by examiner

*Primary Examiner*—Christopher Verdier
(74) *Attorney, Agent, or Firm*—Pillsbury Winthrop LLP

(57) ABSTRACT

A locking device for use in retaining rotationally interengaged components in engagement with one another, the device comprising a body member (16) adapted to be located between adjacent interengaging formations (13, 14) on the components to prevent relative rotation of the components, and a wire retaining member (17) adapted to locate the body member in position, the retaining member comprising at least two hook-like members (18) engaged in spaced apertures (20) in the body member, each hook-like member having first and second portions (18B, 18C) extending beyond the body member into engagement with inner and outer surfaces of one of the components.

12 Claims, 1 Drawing Sheet

LOCKING DEVICES

This invention relates to means for interlocking adjacent components of rotating assemblies to prevent relative rotation between them. The invention is especially, but not exclusively, applicable to devices for interlocking rotary components of gas turbine engines.

In the construction of turbines for gas turbine engines, a circumferential array of radially-extending turbine blades are mounted on the periphery of a turbine disc by engagement of fir tree or other formations at the blade roots with complementary formations formed around the periphery of the disc. Axial movement of the blades relative to the disc is prevented by annular end or seal plates which locate over the interengaged formations and also act as a seal between cooling air flowing through the fir tree formations to the interior of the turbine blades and combustion gases flowing around the turbine blades.

Typically such seal plates are secured in place by means of cooperating radially extending projections and lugs spaced apart around the respective components and arranged such that during assembly the seal plate may be moved axially into engagement with the rotor disc and then rotated to bring the projections and lugs into positions in which they interfere with one another and retain the seal plate in engagement with the disc. Components interconnected in this manner are referred to herein and in the appended claims as "rotationally interengaged components".

Once engaged, the rotor disc and seal plate are locked against relative rotation by means of at least one locking device adapted to be inserted into one of the gaps between adjacent interengaged projections and lugs, the locking device being operable to prevent relative rotation of the disc and seal plate and thus retain the projections and lugs in their interengaged positions. The or each locking device is retained in position by a retaining member adapted to be deformed around a portion of the seal plate.

Previously proposed locking devices for this purpose have suffered from a number of disadvantages. In particular they have required complex machining operations during production and are prone to fretting corrosion and cracking resulting from stresses generated during engine operation.

According to one aspect of the present invention there is provided a locking device for use in retaining rotationally interengaged components in engagement with one another, the device comprising a body member adapted to be located between adjacent interengaging formations on the components in a manner to prevent relative rotation of the components, and a retaining member adapted to locate the body member in position, the retaining member being formed from wire and comprising at least two hook-like members engaged in spaced apertures in said body member, each hook-like member having first and second portions thereof extending beyond said body member into engagement with inner and outer surfaces of one of said components.

Preferably the components comprise a rotor disc and seal plate of a turbine assembly, said portions of said retaining member extending radially outwardly of said body member into engagement with adjacent inner and outer surfaces of said seal plate.

Thus the invention also provides a locking device for retaining a rotationally interengaged seal plate and rotor disc of a gas turbine engine in engagement with one another, the device comprising a body member shaped and dimensioned to form a close fit within a gap between adjacent interengaged lugs and projections on the seal plate and rotor disc, and a retaining member formed from wire and comprising at least two hook-like members engaged in spaced apertures in said body member, each hook-like member having first and second portions extending beyond said body member into engagement with inner and outer surfaces of said seal plate.

Preferably the spacing between said hook-like members differs slightly from the spacing between said apertures in the body member, whereby the retaining member is maintained under tension or compression.

Preferably the retaining member is formed by bending from a single length of wire. Preferably said wire and said apertures are of circular cross-section and of substantially the same diameter, whereby the hook-like members are a close fit in the associated apertures.

Preferably also the opposite ends of the apertures in said body member are of tapered, chamfered or other outwardly increasing cross-section whereby to maximise surface contact between the walls of the aperture and the wire.

The invention also comprises a turbine rotor assembly for a gas turbine engine incorporating a locking device according to the preceding paragraphs.

Thus the invention further provides a turbine rotor assembly for a gas turbine engine comprising a rotor disc having a plurality of blades secured at the periphery thereof, an annular seal plate engageable with said disc to retain said blades against axial movement relative to the disc, means for releasably securing the seal plate to the disc in abutting relationship, said means including circumferentially spaced cooperating formations in the form of projections and recesses on the seal plate and the disc adapted for axial engagement and relative circumferential movement to secure the seal plate to the disc, and a locking device to lock the seal plate and disc against relative rotational movement, the locking device comprising a body member engageable in a gap between adjacent interengaged formations and a retaining member formed by bending from a single length of wire to form a pair of side-by-side hook-like elements each adapted to pass through an associated aperture in said body member and having inner and outer portions thereof extending beyond said body member into engagement with inner and outer surfaces of said seal plate to retain the body member in position in said gap.

An embodiment of the invention will now be described, by way of example only, with reference to the accompanying drawings, in which.

Figure 1:
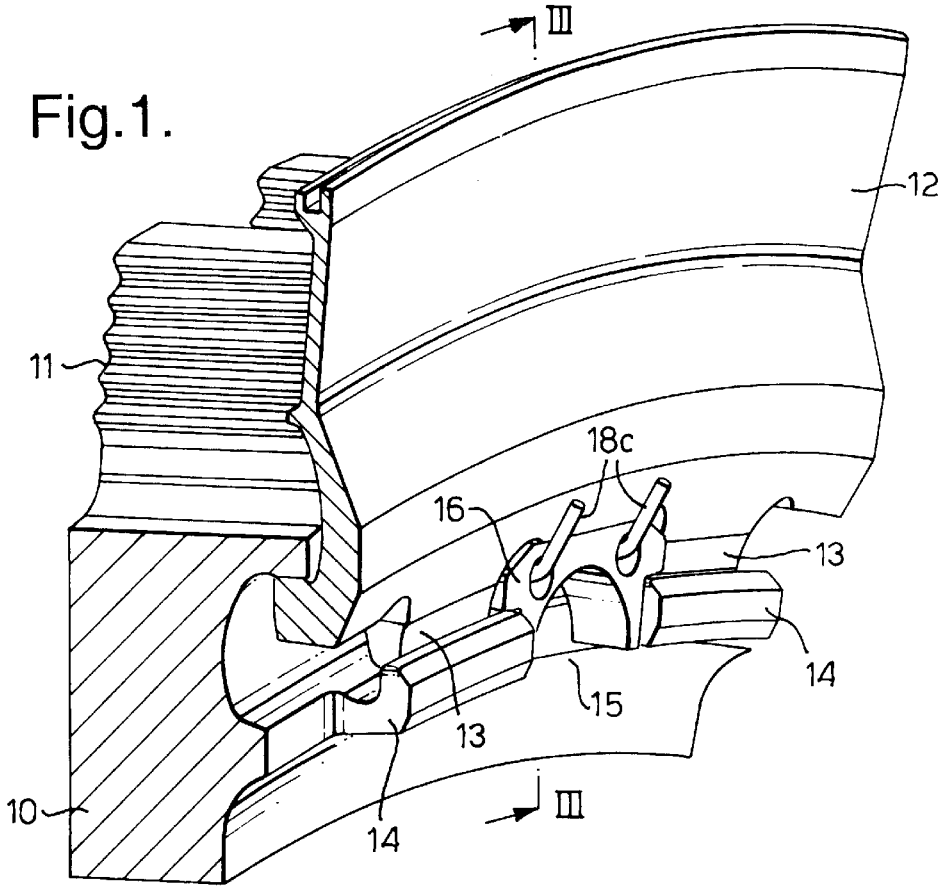
FIG. 1 is a fragmentary perspective view of a rotor disc of a gas turbine engine and an associated seal plate.

Referring to the drawings, there is shown a portion 10 of a turbine rotor disc of a gas turbine engine, the outer periphery of which is formed with a series of fir tree formations 11 by means of which turbine blades are engaged with the periphery of the disc. The blades are retained against axial movement by an annular seal plate 12 held in engagement with the disc 10 by means of a series of radially directed projections 13 on the plate 12 engaged with lugs 14 on the rotor disc 10. The projections 13 and lugs 14 are spaced apart around the circumference of the seal plate and disc such that during assembly the projections 13 may pass through the gaps 15 between adjacent lugs 14, the seal plate then being rotated relative to the disc to engage the projections 13 with the adjacent lugs 14 as shown in FIG. 1. The seal plate is then locked against axial movement relative to the rotor disc until released by effecting relative rotation in one or other direction to bring the projections 13 into alignment with the recesses 15 which enables the seal plate to be removed.

Figure 2:
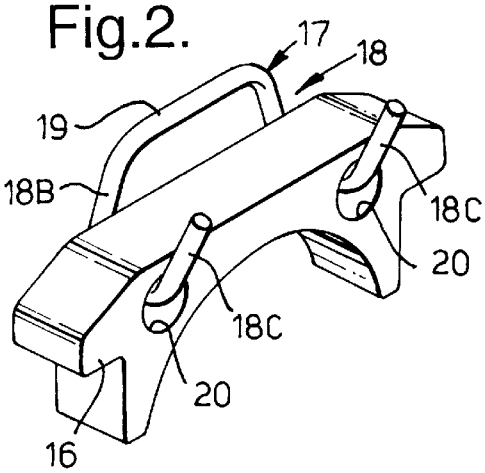
FIG. 2 is a perspective view of a locking device incorporated in the arrangement shown in FIG. 1.

In order to prevent disengagement of the seal plate and disc during operation of the engine, a locking device is provided to prevent relative rotational movement between them. The locking device comprises a body member 16 and a wire retaining member 17 best seen in FIG. 2 of the drawings. The body member 16 is shaped and dimensioned to form a close fit within a selected one of the gaps 15 between adjacent pairs of interengaged projections 13 and lugs 14, whereby to secure same against relative rotation. The body member is retained in position in the gap 15 by the retaining member 17 which is formed by bending from a single piece of wire of circular cross-section to form a pair of side-by-side hook-like formations 18 interconnected by a central linking portion 19. Each hook-like formation 18 comprises a central portion 18A which passes through a circular aperture 20 in the body member 16, and inner and outer portions or members 18B and 18C. The inner and outer members 18B, 18C project radially outwardly beyond the body member 16 and abut against adjacent surfaces 12A and 12B of the seal plate 12.

The distance between the hook-like formations 18 is slightly greater or less than the spacing between the apertures 20 whereby to place the retaining member under tension or compression. For gas turbine applications the wire is preferably formed from a cobalt/chrome alloy selected for high temperature capabilities and high frettage resistance. In a typical application the wire may be of the order of 1.0 to 1.5 mm and preferably 1.2 mm in diameter.

Figure 3:
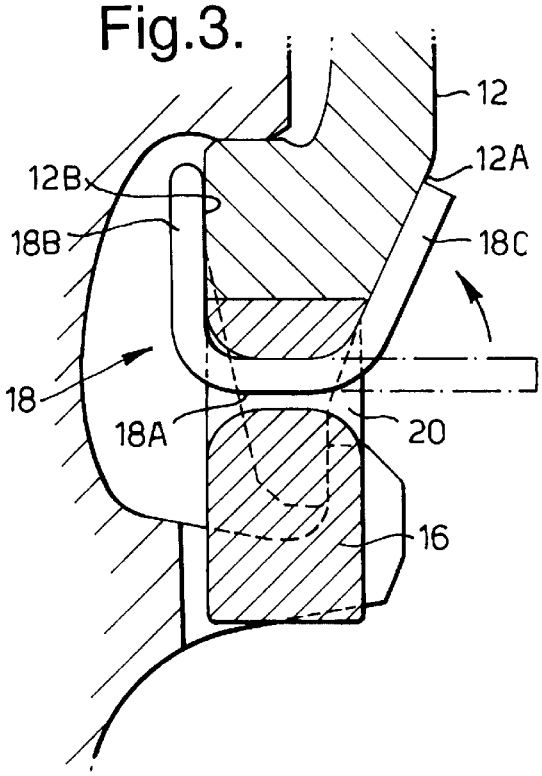
FIG. 3 is a cross-section on the line III—III of FIG. 1.

During operation of the engine, the retaining member is subjected to centrifugal force in a radially outward direction. This forces the retaining member upwards as shown in the drawings and causes plastic deformation of the wire, thus forcing the retaining member more tightly into contact with the adjacent surfaces of the seal plate. This causes intimate contact between the wire and seal plate thereby minimising relative movement between them. In order to further reduce fretting corrosion and cracking of the wire resulting from the stresses induced in the retaining member during operation, the opposite ends of the apertures 20 are contoured to maximise surface contact with the retaining member. Thus as best seen in FIG. 3, the opposite ends of the apertures are of gradually increasing diameter to blend with the curvature of the hook-like formations 18.

In assembling the components, the seal plate is engaged with the rotor disc and rotated to bring the projections 13 into engagement with the lugs 14. The locking device is then located in an appropriate one of the gaps 15 between two of the lugs 14 with the formations 18 partly formed so that the free ends 18C projecting axially from the associated apertures 20 as indicated by the broken lines in FIG. 3. Sections 18C are then deformed into the position shown in full lines in FIG. 3 in which they abut the contoured surface 12A of the side plate. The retaining member thus retains the body member 16, and hence the locking device as a whole, in position in the gap 15 in which it prevents relative rotational movement between the seal plate and the rotor disc.

It will be appreciated that any desired number of locking devices may be located in the gaps 15 between adjacent lugs 14 on the rotor disc. In general a pair of locking devices will be fitted at radially opposite locations in order to minimise additional weight, but a single locking device or more than two such devices could be employed if desired.

The locking device described has a number of benefits compared with previously proposed locking devices for this purpose. In particular the use of wire retaining members engageable with the body member through apertures of circular cross-section simplifies manufacture compared with previous arrangements and thereby results in cost saving. The use of wire retaining members also produces a reduction in weight. Moreover the close fitting nature of the retaining member both with the body member of the locking device and with the adjacent surfaces of the seal plate produces a reduction in movement, stress and wear during use.

Various modifications may be made without departing from the invention. For example, while the illustrated device incorporates two hook-like portions, more than two could be provided if desired. The cross-sectional shape of the wire and of the apertures through which it passes may be other than circular and the wire and apertures may be of different cross-sectional shape from one another. Wire formed from different metals or metal alloys may be used dependent on requirements. Moreover while the invention has been described primarily with the reference to interlocking turbine components of gas turbine engines, it may equally be employed in relation to compressor components or in other situations where interconnected components require to be retained against relative rotational movement.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A locking device for use in retaining rotationally interengaged components in engagement with one another, the device comprising a body member adapted to be located between adjacent interengaging formations on the components in a manner to prevent relative rotation of the components, and a retaining member adapted to locate the body member in position, the retaining member being formed from wire and comprising at least two hook-like members engaged in spaced apertures in said body member, each hook-like member having first and second portions thereof extending beyond said body member into engagement with inner and outer surfaces of one of said components.

2. A locking device according to claim 1 wherein the components comprise a rotor disc and seal plate of a turbine assembly, said portions of said retaining member extending radially outwardly of said body member into engagement with adjacent inner and outer surfaces of said seal plate.

3. A locking device according to claim 1 wherein the spacing between said hook-like members differs slightly from the spacing between said apertures in the body member, whereby the retaining member is maintained under tension or compression.

4. A locking device according to claim 1 wherein said retaining member is formed by bending from a single length of wire.

5. A locking device according to claim 1 wherein said wire and said apertures are of circular cross-section and of substantially the same diameter, whereby the hook-like members are a close fit in the associated apertures.

6. A locking device according to claim 5 wherein the opposite ends of the apertures in said body member are of outwardly increasing cross-section.

7. A locking device for retaining a rotationally interengaged seal plate and rotor disc of a gas turbine engine in engagement with one another, the device comprising a body member shaped and dimensioned to form a close fit within a gap between adjacent interengaged lugs and projections on the seal plate and rotor disc, and a retaining member formed from wire and comprising at least two hook-like members engaged in spaced apertures in said body member, each hook-like member having first and second portions thereof extending beyond said body member into engagement with inner and outer surfaces of said seal plate.

8. A locking device according to claim 7 wherein the spacing between said hook-like members differs slightly from the spacing between said apertures in the body member, whereby the retaining member is maintained under tension or compression.

9. A locking device according to claim 7 wherein said retaining member is formed by bending from a single length of wire.

10. A locking device according to claim 3 wherein said wire and said apertures are of circular cross-section and of substantially the same diameter, whereby the hook-like members are a close fit in the associated apertures.

11. A locking device according to claim 10 wherein the opposite ends of the apertures in said body member are of outwardly increasing cross-section.

12. A turbine rotor assembly for a gas turbine engine comprising a rotor disc having a plurality of blades secured at the periphery thereof, an annular seal plate engageable with said disc to retain said blades against axial movement relative to the disc, means for releasably securing the seal plate to the disc in abutting relationship, said means including circumferentially spaced cooperating formations in the form of projections and recesses on the seal plate and the disc adapted for axial engagement and relative circumferential movement to secure the seal plate to the disc, and a locking device to lock the seal plate and disc against relative rotational movement, the locking device comprising a body member engageable in a gap between adjacent interengaged formations and a retaining member formed by bending from a single length of wire to form a pair of side-by-side hook-like elements each adapted to pass through an associated aperture in said body member and having inner and outer portions thereof extending beyond said body member into engagement with inner and outer surfaces of said seal plate to retain the body member in position in said gap.

* * * * *